US006722653B1

(12) United States Patent
Brumberger et al.

(10) Patent No.: US 6,722,653 B1
(45) Date of Patent: Apr. 20, 2004

(54) MULTIFUNCTION PAPER-PATH GATE SELECTOR AND SHEET RESTRAINT

(75) Inventors: Jesse J. Brumberger, Macedon, NY (US); Richard J. Milillo, Fairport, NY (US); Steven D. Olson, Rochester, NY (US); Harry A. Davidson, Macedon, NY (US); Charles F. Prevost, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/249,644

(22) Filed: Apr. 28, 2003

(51) Int. Cl.[7] ..... B65H 39/10
(52) U.S. Cl. ..... 271/303; 271/305
(58) Field of Search ..... 271/303, 305

(56) References Cited

U.S. PATENT DOCUMENTS

| | | | |
|---|---|---|---|
| 4,871,158 | A | 10/1989 | May et al. |
| 5,513,839 | A | 5/1996 | Green |
| 5,642,876 | A | 7/1997 | Ferrara et al. |
| 5,649,695 | A | 7/1997 | Lawrence |
| 6,003,862 | A | 12/1999 | Russell et al. |
| 6,120,015 | A | 9/2000 | Albright et al. |

OTHER PUBLICATIONS

U.S. patent application Ser. No. 10/361,345, Milillo et al., Filed Feb. 2003.

U.S. patent application Ser. No. 10/604,013, Milillo et al., Filed Jun. 2003.

U.S. patent application Ser. No. 10/248,822, Abbata et al., Filed Feb. 2003.

*Primary Examiner*—Donald P. Walsh
*Assistant Examiner*—Kaitlin Joerger
(74) *Attorney, Agent, or Firm*—Oliff & Berridge, PLC

(57) ABSTRACT

A paper sheet gate actuation and guide system for a paper finishing device includes a guide rail, a drive system, a paper gate unit and a sliding cam unit. The guide rail is disposed along a side of the paper finishing device. The drive system includes a torque supplier to controllably supply torque, a timing belt connected to the torque supplier, and a plurality of pulleys to move laterally along the guide rail when the torque supplier supplies torque. The paper gate unit includes a gate arm to enable a paper sheet to pass through when the gate arm is opened, and a lift foot to open the gate arm when the lift foot is raised. The sliding cam unit includes a shoe to slide along the guide rail, a gate cam to raise the lift foot when engaged against the lift foot, a paddle to push a trailing edge of the paper sheet forward as the paper gate unit moves forward along the guide rail, and a fastener to attach the sliding cam unit to the timing belt.

13 Claims, 4 Drawing Sheets

MULTIFUNCTION PAPER-PATH GATE SELECTOR AND SHEET RESTRAINT

BACKGROUND OF THE INVENTION

1. Field of Invention

This invention relate to finishing devices and sorting devices for printers and/or copiers.

2. Description of Related Art

Devices that process sheets of paper, such as high-speed photocopiers, often require finishing operations to be performed. Such a finishing device causes the paper sheets to be deposited in manner either selected by the user or by a default fashion.

Many finishing devices and sheet stacking devices are known in the sheet handling equipment industry, involving different sheet ejection points for sheets of varying lengths. Conventional finishing devices convey paper sheets through a gate selected from a series of gates based on the length of the sheet being conveyed. Transporting the sheets to a compiling area in the finishing device typically requires redundant drive devices. In addition, a sheet constraint may be needed to align the trailing edge of the sheet as and/or after it passes through the appropriate gate.

In addition to multiple gate selectors, separate sheet constraints are employed in commercially available finishing devices. Consequently, a large number of moving components are required to complete a sheet finishing process, resulting in reduced reliability and shorter service life than desired.

SUMMARY OF THE INVENTION

In most downhill compiling systems, a different sheet ejection point is required for sheets of different lengths. Such systems in finishing and sorting devices typically use a series of gates to direct a sheet along a paper path. The sheet passes through an appropriate gate that is selected and actuated based on the length of a sheet being conveyed.

This invention provides devices and methods for opening a paper gate by a gate cam.

This invention further provides devices and methods for pushing a sheet by a paddle connected to the gate cam.

This invention also provides devices and methods for maintaining the gate open by the gate cam for a range of paper lengths.

This invention separately provides devices and methods for moving a gate cam by a stepper motor.

This invention separately provides devices and methods for moving the gate cam along a rail.

In various exemplary embodiments of the methods and devices according to this invention, a paper sheet entering a finishing device passes through a gate selected and controlled by a combined paper path selector, actuator and sheet constraint structure, which is referred to below as a combined gate system. In various exemplary embodiments, the selected gate is actuated by moving a sliding cam unit along one or more guide rails disposed along at least one side of the finishing device.

Upon entering into the finishing device, the sheet is transported along nip rollers until passing through the appropriate gate, which has been selected and opened based on the size of the sheet being conveyed by the combined gate system.

In various exemplary embodiments, the sliding cam unit includes a gate cam to raise a follower for actuating the gate.

In various exemplary embodiments, the gate cam includes a forward ramp for a head surface, a horizontal plateau, and a rearward ramp for a tail surface.

In various exemplary embodiments, a paddle on the combined gate device constrains the sheet from becoming misaligned after passing through the combined gate device.

In various exemplary embodiments, the movable cam is connected to a sliding cam unit that moves along the guide system or structure by a drive system. In various exemplary embodiments, the drive system includes a stepper motor to move a driver belt that is connected to the sliding cam unit.

In various exemplary embodiments, the sliding cam unit travels over the one or two guide rails on polymer shoes or sliding structures. The sliding cam unit includes a gate cam formed as a wedge from molded plastic. In various exemplary embodiments, the rail and shoe materials are low friction materials.

The combined gate system enables precisely timed and positioned control of a sheet passing through to a finishing station. By combining gate actuation allowing a sheet to pass through with a paddle for preventing backlash of a sheet, the combined gate system improves reliability with fewer moving parts.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the methods of this invention will be described in detail with reference to the following figures, wherein.

DETAILED DESCRIPTION OF EXEMPLARY EMBODIMENTS

Figure 1:
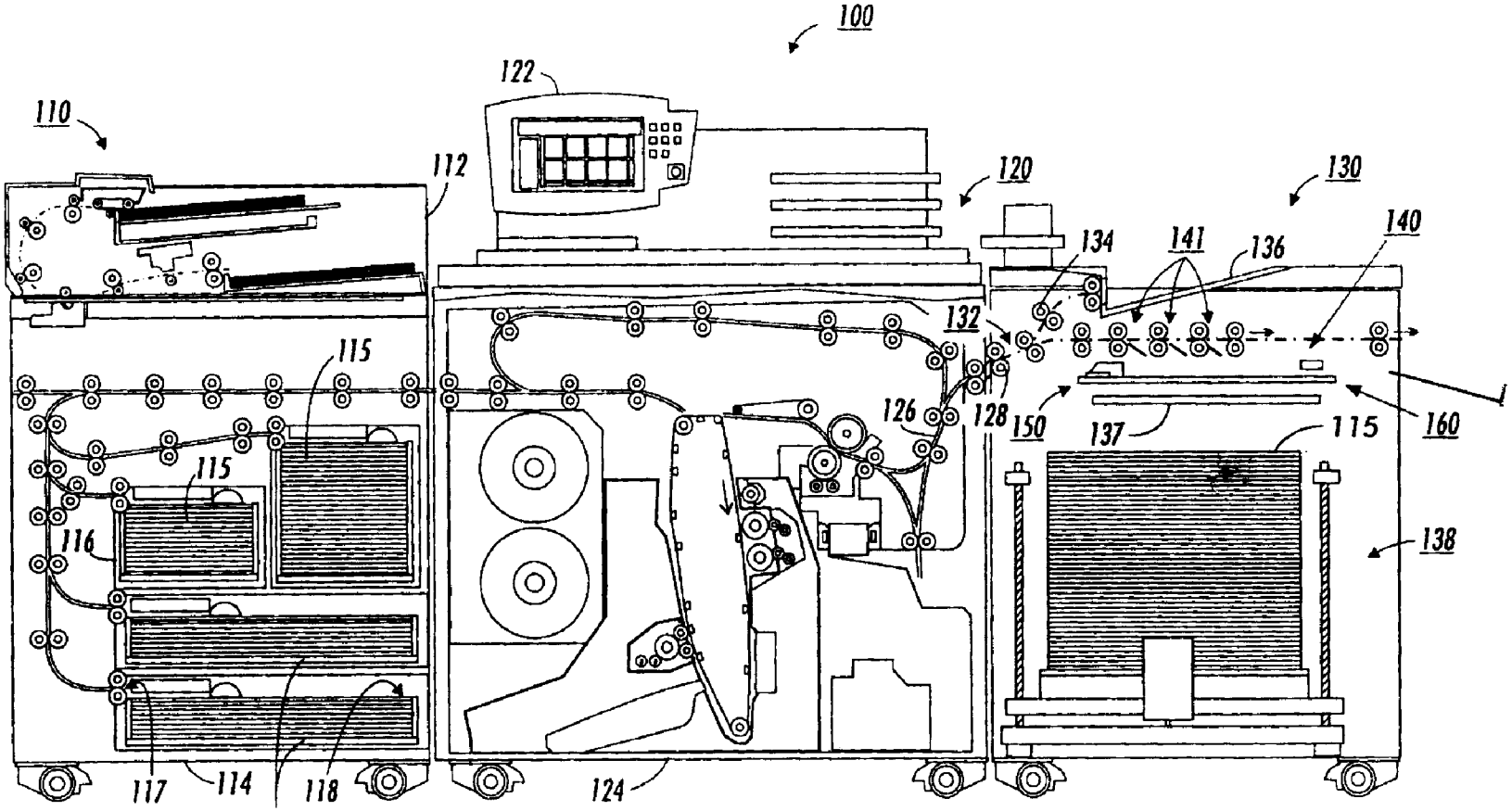
FIG. 1 is an elevation view of one exemplary embodiment of a document handling apparatus in accordance with this invention.

In most downhill compiling systems, a different sheet ejection point is required for sheets of different lengths. Such systems in finishing devices typically use a series of gates to direct a sheet along a paper path. The sheet passes through an appropriate gate that is selected and actuated based on the length of a sheet being conveyed. In various exemplary embodiments, the selected gate is actuated by moving a sliding cam unit along one or more guide rails or rods disposed along at least one side of the finishing device.

A sheet of paper is fed horizontally into the finishing or sorting device and passes between pairs of nip rollers to control the velocity of the sheet along a guide path. The sheet passes through one of a series of gates, depending on the size of the sheet. The gates are sequenced with, the first gate for the largest and progressing downstream towards the last gate for the smallest sheets. The sheet is ejected through a selected gate by air pressure.

In various exemplary embodiments, motion is imparted to the sliding cam unit by a timing belt and pulleys connected to a stepper motor. The stepper motor allows precisely placing of the sliding cam unit to open the selected gate. The stepper motor provides repeatable performance over a long service life. In various other exemplary embodiments, motion to the sliding cam unit is imparted by a direct current motor, a lead screw or a separate solenoid for each gate.

In various exemplary embodiments, the drive system is also used to position a trailing edge of the sheet by using a rear paper restraining tamper or paddle to push the trailing edge of the sheet forward. Concurrent with opening the gate, the stepper motor positions the paddle for the length of the sheet of paper being conveyed along the guide path. The paddle can be moved back and forth a short distance without deactuating the selected gate, due to short flat surfaces on top of the gate cam.

In various exemplary embodiments, a long shuttle arm connects the paddle to the gate cam. The paddle can be positioned at the end of the shuttle arm that runs out to the mid-span of the guide path width. A paper-contact surface of the paddle can be fitted with a textile "grass" or other non-slip fibrous material to reduce slippage of the sheet and thereby prevent the edge of the sheet from sliding laterally or longitudinally along the paddle surface. The shuttle arm has provision for vertical adjustment.

The gate cam lifts sled-shaped followers as the gate cam travels down the guide path. Each follower or lift foot is attached to a single paper-diverting gate and pivots the appropriate gate open when lifted by the gate cam. The followers are vertically adjustable to ensure that each gate may open fully without jamming.

The gates are selected according to the lengths of the paper sheets to be run through the finishing device. The gate cam has a plateau on top allowing the gate cam to be positioned within a given length range while under each gate. This range allows the stepper to position the paddle into precise proximity to the trailing edge for each of the several paper lengths that may be fed through a particular gate. For example, letter size and A4 sheets can pass through the same gate, both standards having similar but not identical lengths. After several sheets have passed through one of the gates, the sheets rest on a temporary compiler to accumulate a set of sheets. When the temporary compiler is subsequently retracted to drop any sheets that may be suspended towards a collection station, the paddle prevents these sheets from retreating backwards.

The gate cam has head and tail surfaces extending from either side of the plateau. As the stepper motor moves the sliding cam unit forward or backward along the one or more guide rails, the head or tail surface of the gate cam engages the follower or lift foot on the selected gate. As the gate cam moves farther forward or backward, the follower is positioned within the plateau on top of the gate cam. The vertical rise of the follower causes the selected gate to open to allow the sheet to pass through that gate. Because the stepper motor translates the sliding cam unit so that the follower is positioned within the cam plateau at precisely defined times and positions, the sheet can be controlled through the selected gate accurately and reliably.

These principles can be depicted by the accompanying drawings. FIG. 1 provides an elevation view of a document handling apparatus 100, such as a photocopier having an automatic document handler 110, a transfer station 120 and a finishing device 130. The document handler 110 includes a document source system 112 and a paper supply 114. The document source system 112 feeds an original document to scan the image contents as scan signals. The paper supply 114 contains paper sheets 115 held in trays 116 based on their particular sizes. The sheets 115 are fed from the trays 116 from their leading edges 117 to their trailing edges 118.

The transfer station 120 includes a control panel 122 and a transfer station 124. The control panel 122 receives commands from the user for execution by the document handling apparatus 100. The transfer station 124 receives the scan signals from the document source system 112 to produce a toner image, which is transferred to a sheet 115 of paper or other medium. After the toner image transfer is completed, the sheet 115 is guided by a transfer guide mechanism 126 to exit from the transfer station 124 through an aperture 128 to the finishing device 130.

The sheet 115 is guided into the finishing station 130 along a sheet path by a finisher guide mechanism 132 between nip rollers 134. For small output quantities that do not require any further processing or manipulation, the sheet 115 is then ejected to an output tray 136. Larger output quantities require more elaborate stacking operations. Additionally, sets of any size may require manipulation by a manipulation device, such as a stapler, a hole punch, a perforation, a binder or the like. For such circumstances, the sheet 115 continues along the finisher guide mechanism 132 to a temporary compiler 137 for sorting and finishing before being deposited onto a collection station 138. The sheets 115 are sorted by paper length through a diverter gate system 140.

In various exemplary embodiments, the finishing device 130 contains structures and systems that operate on the sheets 115 before being deposited on the collection station 138 for cumulative stacking. The diverter gate system or unit 140 includes a series of diverter gates 141. These mechanisms on the diverter gate system 140 distinguish the sheets 115 based on the length of the sheets. A sliding cam unit 150 activates a selected diverter gate 141 to open and allow a sheet 115 to pass through that diverter gate 141. The sliding cam assembly 150 is moved along by a positioning system 160. These assemblies and systems are described in further detail below.

Figure 2:
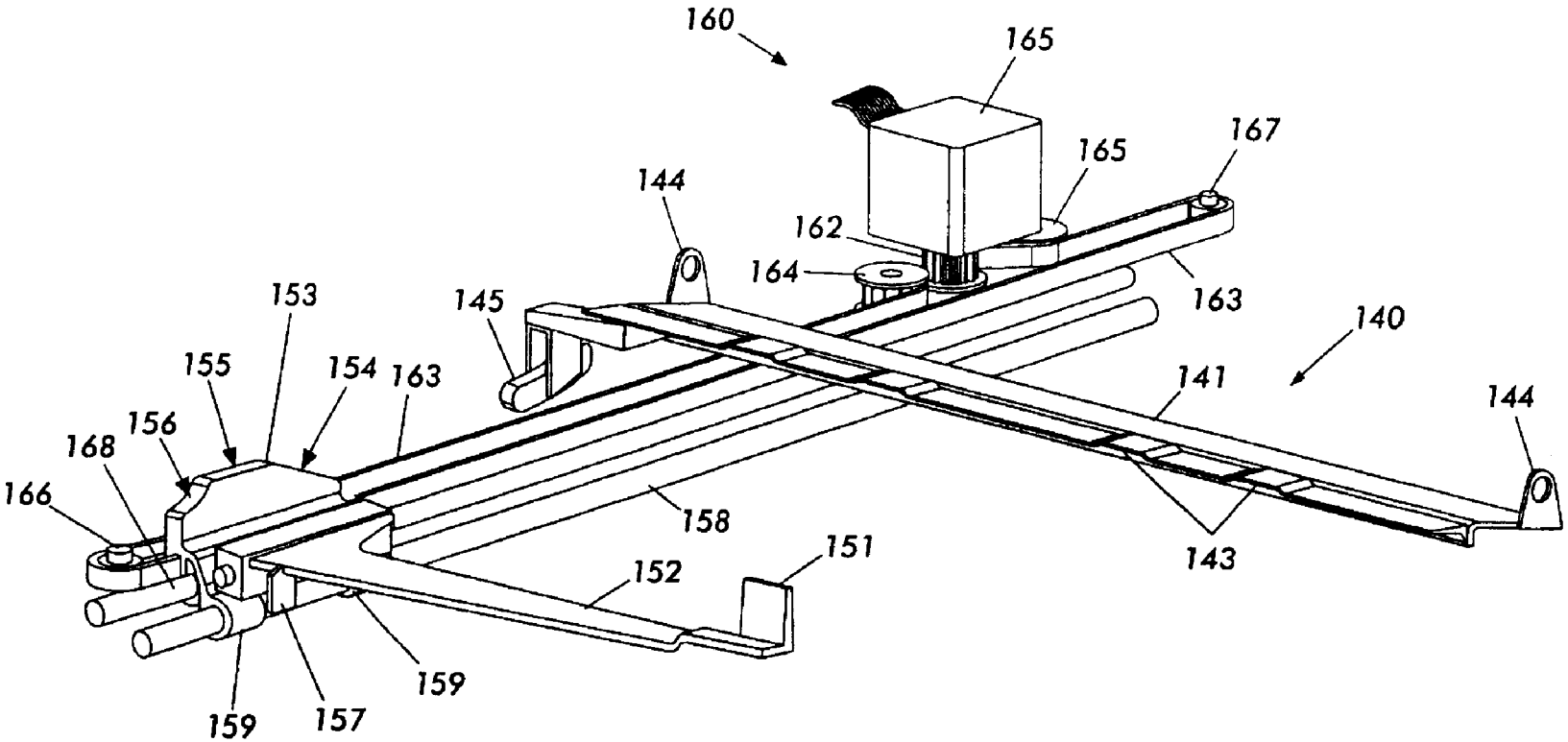
FIG. 2 is an isometric view of an exemplary embodiment of a combined gate device in accordance with this invention.
Figure 3:
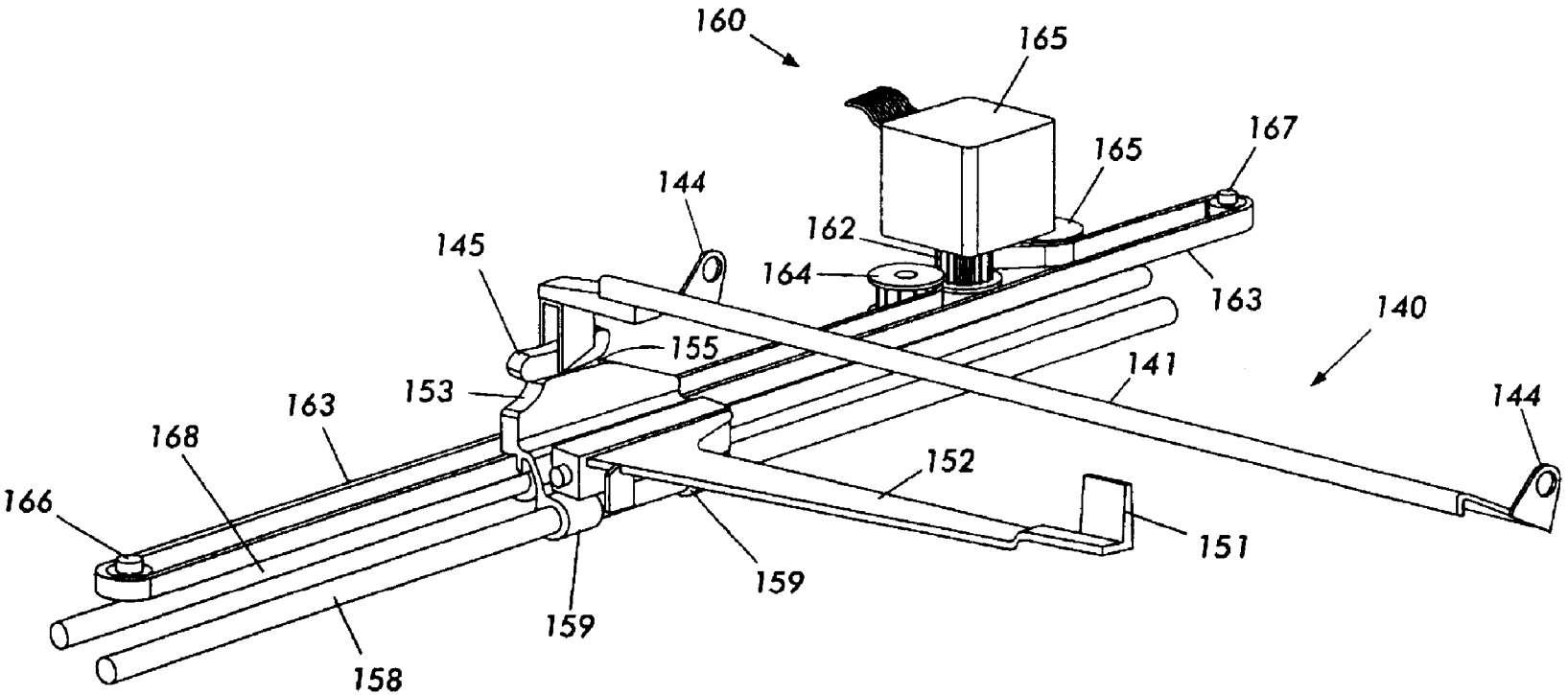
FIG. 3 is an isometric view of the exemplary embodiment of the combined gate device of FIG. 2 with the gate activated by the cam.

FIGS. 2 and 3 show isometric views of various exemplary embodiments of the diverter gate system 140, the sliding cam assembly (or unit) 150 and the positioning system 160. FIG. 2 shows the sliding cam assembly 150 while approaching diverter gate system 140. FIG. 3 shows the sliding cam assembly 150 engaging the diverter gate system 140.

The diverter gate assembly 140 includes a series of diverter gates 141. Depending on the length of the sheet 115, an appropriate diverter gate 141 is selected to intercept the sheet 115 as the sheet 115 is transported by the finisher guide mechanism 132. Each diverter gate 141 includes a gate arm 142 that intercepts the sheet 115, one or more ribs 143 that guide the sheet 115, edge tampers 144 that limit lateral migration of the sheet 115 and a lift foot or follower 145.

The sliding cam assembly 150 includes a gate cam 153. The sliding cam assembly 150 also includes a paddle 151 attached to the gate cam 153 by a shuttle arm 152. The gate cam 153 includes a head surface 154, a plateau or short flat surface 155, and a tail surface 156. The gate cam 153 and shuttle arm 151 are attached to each other by one or more flanges 157. One or more guide rods or rails 158 along one edge of the finishing device 130 provide the path along, which the sliding cam assembly 150 travels. The flanges 157 are attached to one or more guide sleeves or shoes 159, which wrap around the one or more guide rods 158 so the sliding cam unit 150 moves along the direction of the guide rod 158.

The head surface 154 extends horizontally forward from the plateau 155 and vertically from below the lift foot 145 at rest to the plateau 155, providing a forward curvilinear ramp. Similarly, the tail surface 156 extends horizontally rearward from the plateau 155 and vertically from the plateau 155 to below the lift foot 145, providing a rearward curvilinear ramp. The forward and rearward curvilinear ramps form angles relative to the guide rails 158 that are adjusted based on minimized vertical acceleration of the lift foot 145, the desired speed of the sliding cam assembly 150 and the available length of travel along the guide rod 158.

As the sliding cam unit 150 moves forward along the guide rod 158, the head or tail surface 154 or 156 engages the lift foot 145. The plateau 155 raises or pivots the lift foot 145, causing the gate arm 142 to change orientation. This opens the gate arm 142 of the diverter gate system 140 allowing the sheet 115 to pass through towards the temporary compiler 137, as shown in FIG. 3, while the paddle 151 pushes the sheet 115 along the trailing edge 118.

The sliding cam assembly 150 is transported along the guide rod 158 by a positioning system 160. In various exemplary embodiments, the positioning system 160 includes a stepper motor 161. The stepper motor 161 precisely moves the sliding cam assembly 150 along the one or more guide rods 158. Rotational movement of the stepper motor 161 is transferred from a rotor 162 by a timing drive belt 163 suspended between two side pulleys 164 and 165 on either side of the stepper motor 161. In other various exemplary embodiments, the positioning system includes a solenoid to activate a single gate.

The drive belt 163 is connected to the sliding cam assembly 150 between two end pulleys 166 and 167 by a fastener 168. The stepper motor 161 turns the rotor 162. This moves the drive belt 163 to slide the sliding cam assembly 150 towards the selected diverter gate 141. The stepper motor 161 can be controlled by a controller (not shown) based on instructions provided through the control panel 122. In various exemplary embodiments, the positioning system 160 can be positioned outboard of the sliding cam assembly 150, as shown in FIGS. 2 and 3. In other various exemplary embodiments, the positioning system 160 can be positioned inboard of the sliding cam assembly 150.

Figure 4:
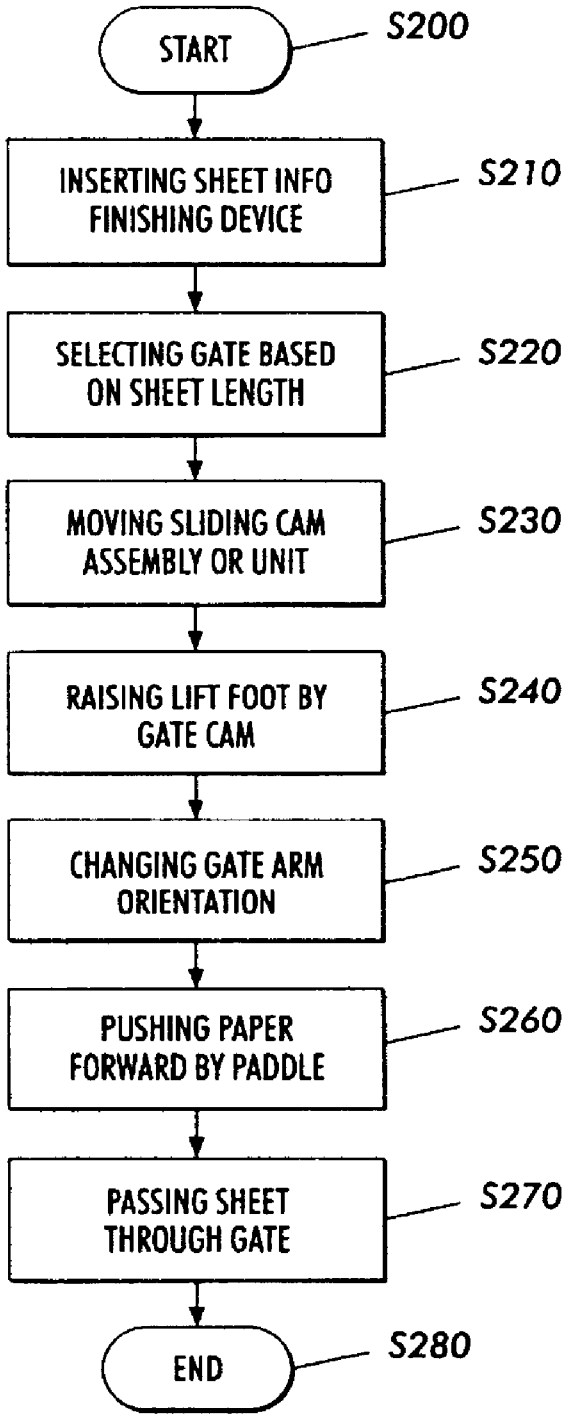
FIG. 4 is a flowchart outlining one exemplary embodiment of a method for selecting and restraining a sheet within a finishing device according to this invention.

FIG. 4 is a flowchart outlining one exemplary embodiment of a method for controlling the diverter gate system 140, the sliding cam assembly 150 and/or the positioning system 160, in the finishing device 130. Beginning in step S200, operation continues to step S210, where the leading edge 117 of the sheet 115 enters the finishing device 130 through the aperture 128 and is acquired by the nip rollers 134. Next, in step S220, one of the diverter gates 141 of the finishing device 130 is selected based on the length of the sheet 115. Then, in step S230, the positioning system 160 moves the sliding cam assembly 150 on the shoes 159 along the one or more guide rods 158 until the sliding cam assembly 150 is adjacent an edge of the finishing device 130. Operation then continues to step S240.

In step S240, the gate cam 153 on the sliding cam assembly 150 raises the lift foot 145 on the selected diverter gate 141. Then, in step S250, the lift foot 145 causes the gate arm 142 to change orientation such that the sheet 115 is diverted from the finisher guide mechanism 132. Next, in step S260, the sliding cam assembly 150 is moved forward and backward so that the paddle 151 on the shuttle arm 152 tamps and pushes the trailing edge 118 of the sheet 115 forward. However, because of the plateau 155, the lift foot 145 of the selected diverter gate 141 does not disengage from the sliding cam assembly 150. Then, in step S270, moving the gate arm 142 allows the sheet 115 to pass through, while ribs 143 and edge tampers 144 limit lateral movement of the sheet 115. Operation then continues to step S280, where operation of the method terminates.

While this invention has been described in conjunction with exemplary embodiments outlined above, many alternatives, modifications and variations will be apparent to those skilled in the art. Accordingly, the exemplary embodiments of the invention, as set forth above, are intended to be illustrative, not limiting. Various changes can be made without departing from the spirit and scope of the invention.

What is claimed is:

1. A sheet gate actuation and guide system of a finishing device, comprising:

at least one guide rail disposed along a side of the finishing device;

a drive system, including:

a motor, and a timing belt connected to the motor and supported by a plurality of pulleys;

a plurality of selectably-actuatable gates usable to divert a sheet from a sheet path into the finishing device, each selectively-actuatable gate including:

a gate arm that allows the sheet to pass through when the gate arm is opened, and a lift foot that opens the gate arm when the lift foot is raised; and a sliding cam unit, including:

a sliding structure that slides along the guide rail, a gate cam that raises the lift foot when engaged with the lift foot, and a paddle that pushes a trailing edge of the sheet forward as the sliding cam unit moves forward along the guide rail, wherein the sliding cam unit is attached to the timing belt.

2. The sheet gate actuation and guide system according to claim 1, wherein the motor is a stepper motor.

3. The sheet gate actuation and guide system according to claim 1, wherein the sliding cam unit is formed from molded plastic.

4. The sheet gate actuation and guide system according to claim 1, wherein the guide rail is a rod and the sliding structure is a low-friction polymer sleeve.

5. The sheet gate actuation and guide system according to claim 1, wherein the paddle has a non-slip surface.

6. The sheet gate actuation and guide system according to claim 1, wherein the gate arm has an edge tamper.

7. The sheet gate actuation and guide system according to claim 1, wherein the gate cam has a lead edge surface, a trail edge surface, and a plateau surface extending between the lead and trail edge surfaces.

8. The sheet gate actuation and guide system according to claim 7, wherein the lift foot of a selected selectively-actuatable gate is lifted to open that selectively-actuatable gate when the lift foot is positioned within the plateau of the gate cam.

9. A method for actuating a gate of a finishing device having a guide rail along a side of the finishing device, and a timing belt, comprising:

supplying controllable motive power to the timing belt; and moving a plurality of pulleys laterally along the guide rail when the timing belt receives the torque.

10. The method according to claim 9 further including pushing a trailing edge of the sheet forward by a paddle.

11. The method according to claim 10 further including coating the paddle with a non-slip surface.

12. The method according to claim 9 further including tamping the trailing edge of the paper sheet by the gate arm.

13. The method according to claim 9, wherein engaging the lift foot by the gate cam uses a lead edge surface and a plateau surface.

* * * * *